US006561452B2

(12) United States Patent
Adams

(10) Patent No.: US 6,561,452 B2
(45) Date of Patent: May 13, 2003

(54) APPARATUS AND METHOD FOR DISPENSING COILED METALLIC RIBBON

(76) Inventor: Ellen Louise Adams, 1928 E. Panama Dr., Littleton, CO (US) 80121

( * ) Notice: Subject to any disclaimer, the term of this patent is extended or adjusted under 35 U.S.C. 154(b) by 0 days.

(21) Appl. No.: 09/854,387

(22) Filed: May 11, 2001

(65) Prior Publication Data

US 2002/0166919 A1 Nov. 14, 2002

(51) Int. Cl.[7] ..... B65H 16/02; B65H 16/10

(52) U.S. Cl. ..... 242/564.5; 242/588.4

(58) Field of Search ..... 242/588.3, 588.4, 242/595, 595.1, 564.5, 348.3, 332.5; 206/395, 409

(56) References Cited

U.S. PATENT DOCUMENTS

| | | | | | |
|---|---|---|---|---|---|
| 1,154,212 | A | * | 9/1915 | Schloss | 242/588.3 |
| 2,237,920 | A | * | 4/1941 | Armitt | 242/588.4 |
| 2,255,577 | A | * | 9/1941 | Wilkie | 242/588.3 |
| 2,310,140 | A | * | 2/1943 | Wilkie | 242/588.3 |
| 2,331,675 | A | * | 10/1943 | Frost | 242/564.5 |
| 2,333,099 | A | * | 11/1943 | Gerking | 242/588.3 |
| 2,359,871 | A | * | 10/1944 | Mueller | 242/595 |
| 2,589,192 | A | * | 3/1952 | Johnston | 242/588.4 |
| 2,930,479 | A | * | 3/1960 | Lowe | 242/588.4 |
| 3,016,135 | A | * | 1/1962 | Green | 242/588.4 |
| 3,129,810 | A | * | 4/1964 | Wilkens | 242/588.4 |
| 3,129,813 | A | * | 4/1964 | Norvelle | 242/588.3 |
| 3,488,016 | A | * | 1/1970 | Mouissie | 242/348.3 |
| 3,489,370 | A | * | 1/1970 | Mouissie | 242/332.5 |
| 3,627,118 | A | * | 12/1971 | Daggs | 242/588.4 |
| 3,810,588 | A | | 5/1974 | Mahoney | |
| 3,861,610 | A | * | 1/1975 | Landis et al. | 242/564.5 |
| 3,944,072 | A | | 3/1976 | Budington et al. | |
| 4,396,165 | A | | 8/1983 | Bates et al. | |
| 4,757,958 | A | * | 7/1988 | Elliott et al. | 242/345.3 |
| 4,978,085 | A | * | 12/1990 | Letourneau | 242/588.3 |
| 5,284,247 | A | * | 2/1994 | Turner | 206/395 |

* cited by examiner

*Primary Examiner*—John M. Jillions
(74) *Attorney, Agent, or Firm*—F. Chau & Associates, LLP

(57) ABSTRACT

Apparatus and methods for packaging and dispensing coiled material. A device for packaging a coil of metallic ribbon stock comprises a first planar panel and a second planar panel, wherein the first and second planar panels have substantially the same shape, and a sidewall panel that interconnects the first and second planar panels along the perimeter of the first and second planar panels to form a container. The sidewall panel comprises preferably comprises a plurality of perforated regions each defining an aperture through which a roller is inserted to rotatably engage a coil of metallic ribbon stock within the container. An apparatus for dispensing lengths of metallic ribbon stock from a dispenser containing a coil of metallic ribbon stock comprises a mounting device for mounting the dispenser, a plurality of roller assemblies, each comprising a roller, and a positioning device operatively connected to each roller assembly, wherein for a given roller assembly, the positioning device operates to insert at least a portion of the roller through an aperture of the dispenser for rotatably engaging the roller with the coil of metallic ribbon stock.

18 Claims, 6 Drawing Sheets

APPARATUS AND METHOD FOR DISPENSING COILED METALLIC RIBBON

BACKGROUND

1. Technical Field

The present invention relates generally to apparatus and method for dispensing coiled metallic ribbon stock and, in particular, to a packaging device for packaging and dispensing coiled metallic ribbon stock, and an apparatus and method for dispensing coiled metallic ribbon stock from such packaging device.

2. Description of Related Art

Currently, coiled metallic material (e.g., steel rule stock, or any type of metallic ribbon stock) is typically packaged and distributed in standard rectangular paperboard packaging. There are various problems associated with conventional packaging techniques. For instance, a coil of metallic material typically comprises a resilient metal band that is closely wound under tension such that the coiled material comprises characteristics of a large watch spring. Unless the coiled material is adequately restrained while it is being removed from the package and placed into position into an apparatus that utilizes the coiled material, it can spring apart in disarray and cause harm to the operator. This is especially dangerous with some forms of coiled metallic ribbon stock that have a sharpened or serrated edge.

Another conventional method of packaging coiled metallic material comprises packaging the coiled metallic material in a box containing an opening from which to dispense the coiled material. With this packaging method, however, no measures are typically taken to reduce friction so that the coiled material can be easily drawn out of or retracted into the package. Thus, as one end of the coiled metallic rule is pulled from the opening in the package, a frictional force is generated at points of contact between the coiled material and, e.g., the sidewalls of the package as the coiled material is rotatably dispensed from the package.

Accordingly, more efficient and safer methods of packaging and dispensing coiled metallic ribbon stock are desired, which eliminate the need to remove the coil from the package box and greatly reduce or eliminate the frictional forces generated during a dispensing operation.

SUMMARY OF THE INVENTION

The present invention is directed to a packaging device and a dispensing apparatus, which provide safe and efficient methods for packaging and dispensing coiled material, and which are compatible with currently available systems and devices for processing the coiled metallic material.

In one aspect of the present invention, a device for packaging a coil of metallic ribbon stock comprises a first planar panel and a second planar panel, wherein the first and second planar panels have substantially the same shape, and a sidewall panel that interconnects the first and second planar panels along the perimeter of the first and second planar panels to form a container. The sidewall panel comprises preferably comprises a plurality of perforated regions each defining an aperture through which a roller is inserted to rotatably engage a coil of metallic ribbon stock within the container. A perforated region is removed to create an aperture in the sidewall panel.

The rollers engage the coil in such a way that they are tangent to the coiled material and rotate in the direction in which the coil is withdrawn from or retracted into the packaging device. Preferably, one or more perforated regions (or apertures) are formed in proximity to each point of contact between the inner surface of the sidewall panel and an outer surface of a coil of metallic ribbon stock within the packaging device. Thus, when sufficient force is applied, the roller operates to reduce or eliminate the friction at such points of contact in the packaging device, thereby enabling free movement of the material out of and into the packaging device.

In yet another aspect, the packaging device further comprises a low friction insert connected to the inner surface of the top and bottom panels of the package to further reduce the friction as the coil rotates in the packaging device.

In another aspect, the packaging device further comprises a reinforcement device connected on the inner surface of the sidewall panel in proximity to the perforated region for reinforcing the sidewall panel.

In yet another aspect, the packaging device is formed from a unitary flat blank comprising any suitable material such as paperboard or corrugated cardboard.

In another aspect of the present invention, an apparatus for dispensing lengths of metallic ribbon stock from a dispenser containing a coil of metallic ribbon stock comprises:

a mounting device for mounting the dispenser;

a plurality of roller assemblies, each comprising a roller; and a positioning device operatively connected to each roller assembly, wherein for a given roller assembly, the positioning device operates to insert at least a portion of the roller through an aperture of the dispenser for rotatably engaging the roller with the coil of metallic ribbon stock.

In yet another aspect of the present invention, a system for dispensing lengths of metallic ribbon stock from a dispenser containing a coil of metallic ribbon stock, comprises:

mounting means for mounting the dispenser; and friction reduction means for tangentially engaging the metallic ribbon stock through one or more apertures in the dispenser to aid in the dispensing of the stock.

The friction reduction means may operate under manual control or under a servo control.

These and other objects, features and advantages of the present invention will be described or become apparent from the following detailed description of preferred embodiments, which is to be read in connection with the accompanying drawings.

BRIEF DESCRIPTION OF DRAWINGS

FIGS. 5, 6 and 7 comprise schematic diagrams collectively illustrating a method and apparatus for dispensing coiled metallic ribbon stock according to an embodiment of the present invention, wherein FIG. 5 illustrates a dispensing apparatus in a state of operation prior to engaging an packaging device comprising a coiled metallic ribbon stock, FIG. 6 is a schematic of a roller assembly that is used in the dispensing apparatus to rotatably engage the coiled metal ribbon stock through apertures in the packaging device, and wherein FIG. 7 illustrates the dispensing apparatus in a state of operation after engaging the packaging device.

DETAILED DESCRIPTION OF PREFERRED EMBODIMENTS

Figure 1:
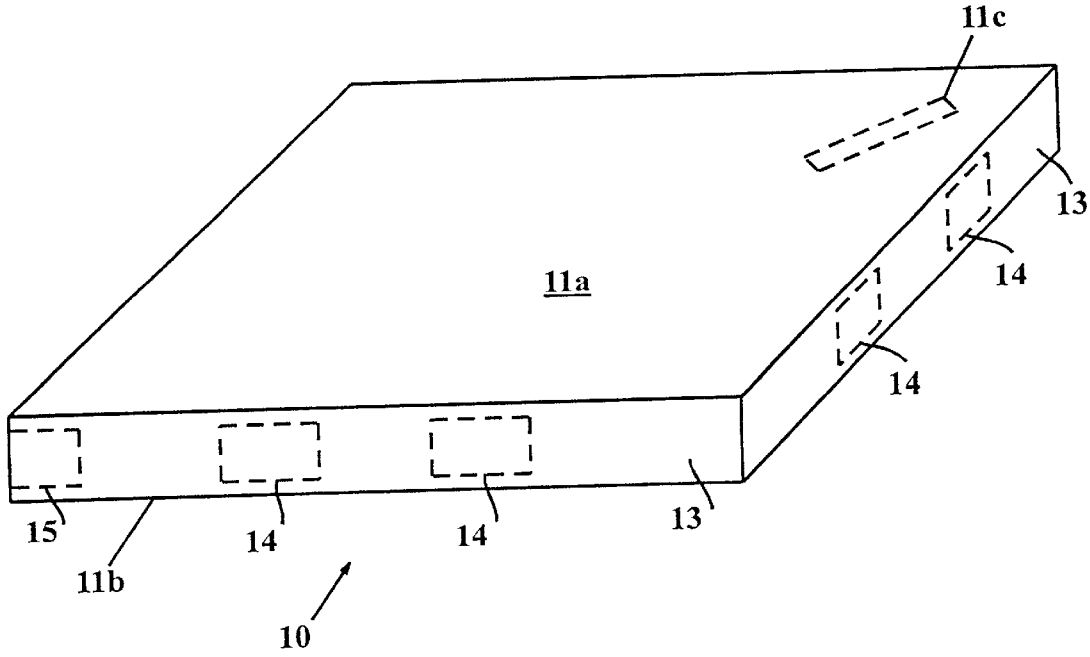
FIG. 1 is a schematic view of a device for packaging coiled metallic ribbon stock according to an embodiment of the present invention.
Figure 2:
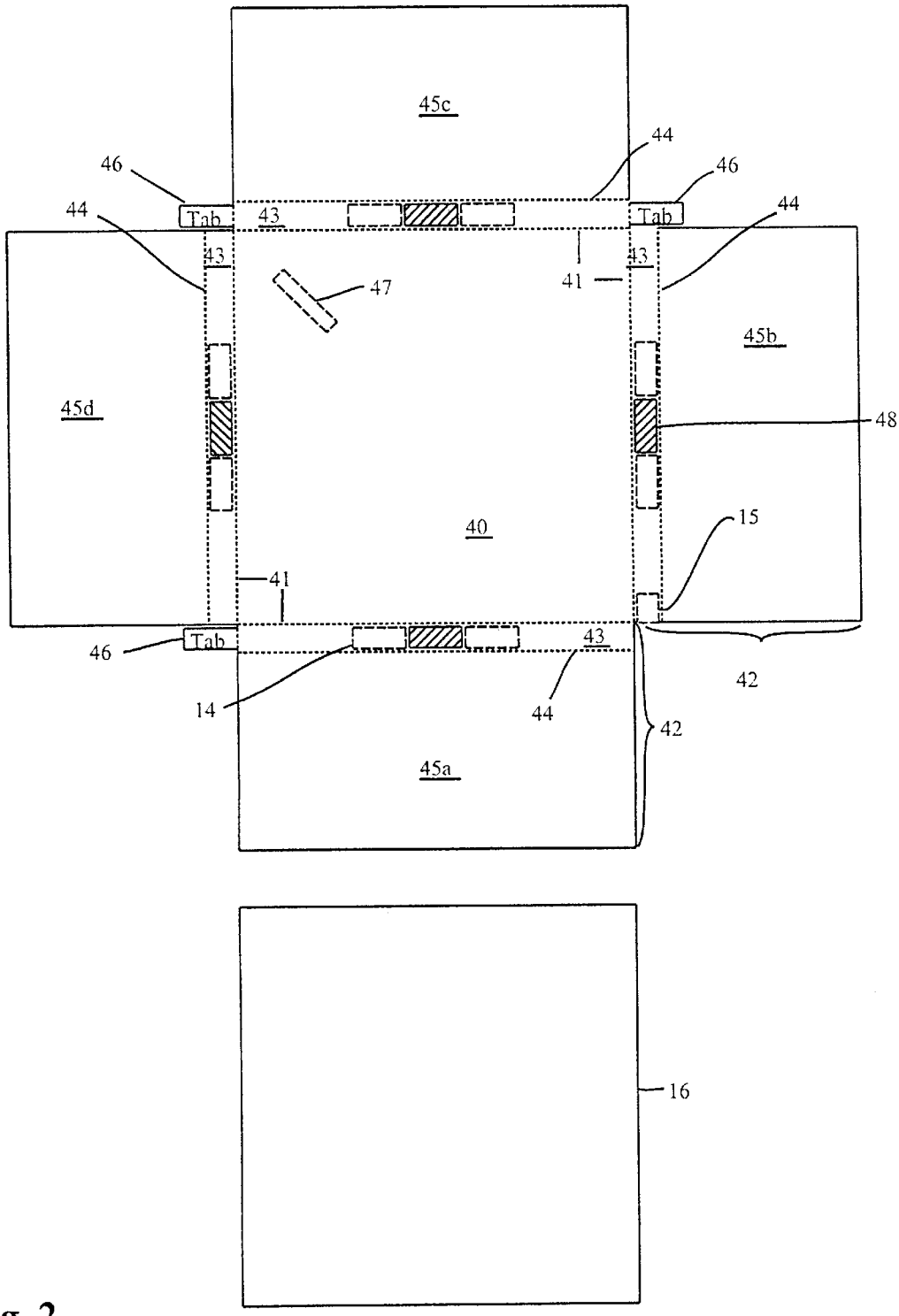
FIG. 2 is a plan view of a flat unitary carton blank according to an embodiment of the present invention from which the packaging device of FIG. 1 may be formed.
Figure 3:
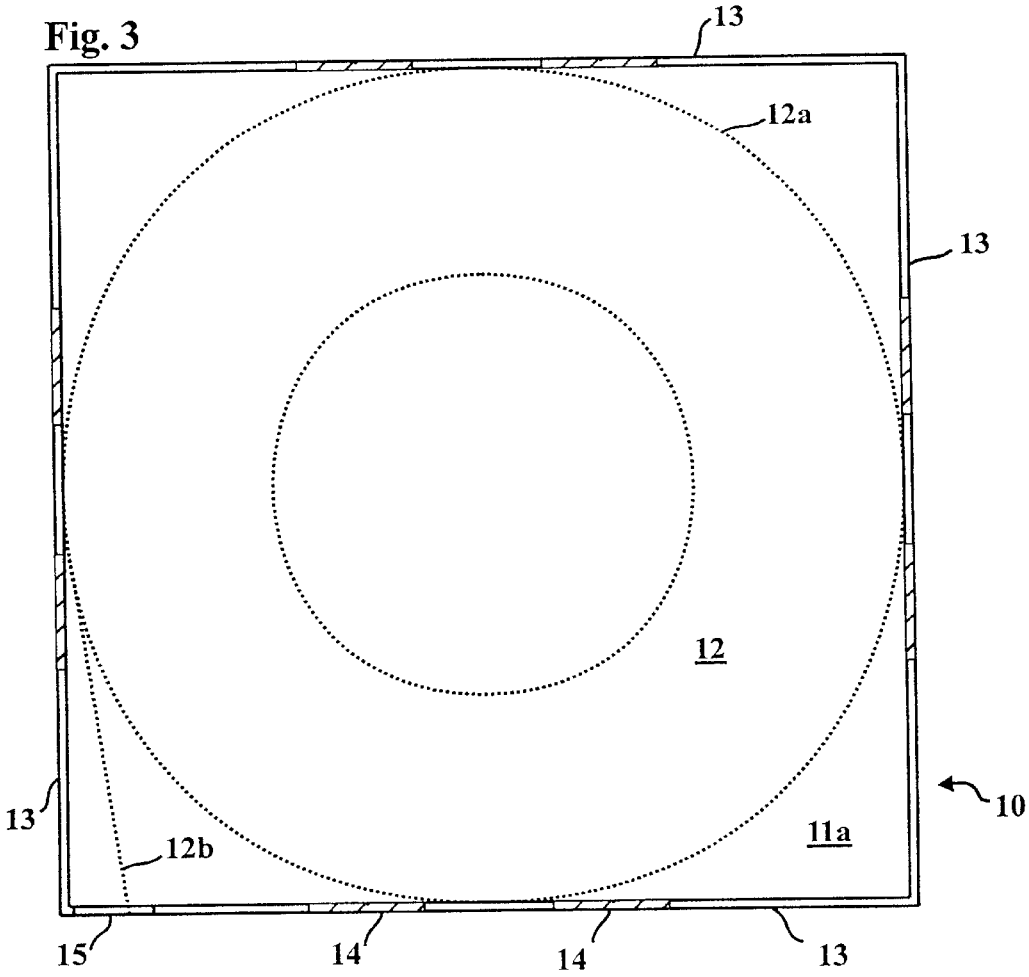
FIG. 3 is a top plan view of one side of a packaging device for coiled metallic ribbon stock according to an embodiment of the present invention.

FIGS. 1, 2, and 3 illustrate a packaging device (or "dispenser") according to an embodiment of the present invention for packaging coiled metallic ribbon stock. The device comprises a container 10 comprising a first panel 11*a* (or top panel) and a second panel 11*b* (or bottom panel) and a plurality of sidewalls 13. A coil 12 of metallic ribbon stock is contained within the container 10. The container 10 is preferably formed of any material used by those skilled in the art (e.g., cardboard) for packaging coiled metallic ribbon stock. In the exemplary embodiment, the container 10 is shown in the form of a rectangular box, although one skilled in the art may readily envision other shapes that may be used to form the packaging device.

The four sidewalls 13 are preferably integrally formed with and extend at right angles from one of the upper or lower sections 11*a*, 11*b* (or both) of the container 10. Each of the side walls 13 comprise one or more perforated portions 14,15 defining apertures that are employed for dispensing metallic stock from the package. In particular, as shown in FIG. 3, perforated portions 14 are preferably disposed on sidewalls 13 of the container 10 at, or in proximity to, locations where the outer surface 12*a* of the coiled metallic material 12 makes contact with the inner surface of the sidewalls 13. Further, a perforated portion 15 defines an aperture or slot through which the free end 12*a* of the metallic coil 12 may be withdrawn from the package (either manually or via machine). The perforated portion 15 is preferably located on one sidewall 13 at one corner of the container 10. It is to be appreciated that the perforated portions 14 and 15 preferably comprise pulltabs that can be pulled off to form corresponding apertures in the container 10 prior to use of the metallic coil 12. Alternatively, the container 10 may be formed such that the perforated portions 14, 15 are removed during manufacture of the packaging device.

Figure 5:
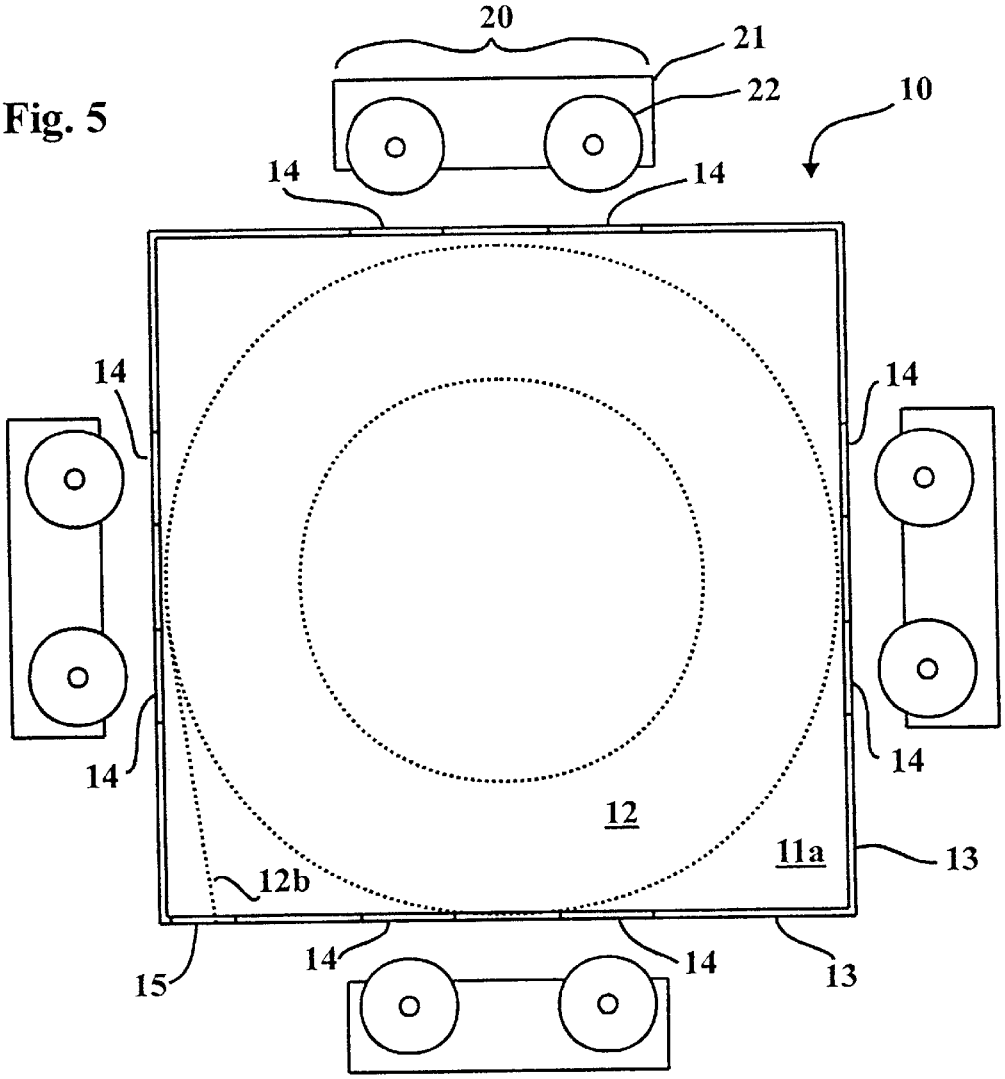
Figure 7:
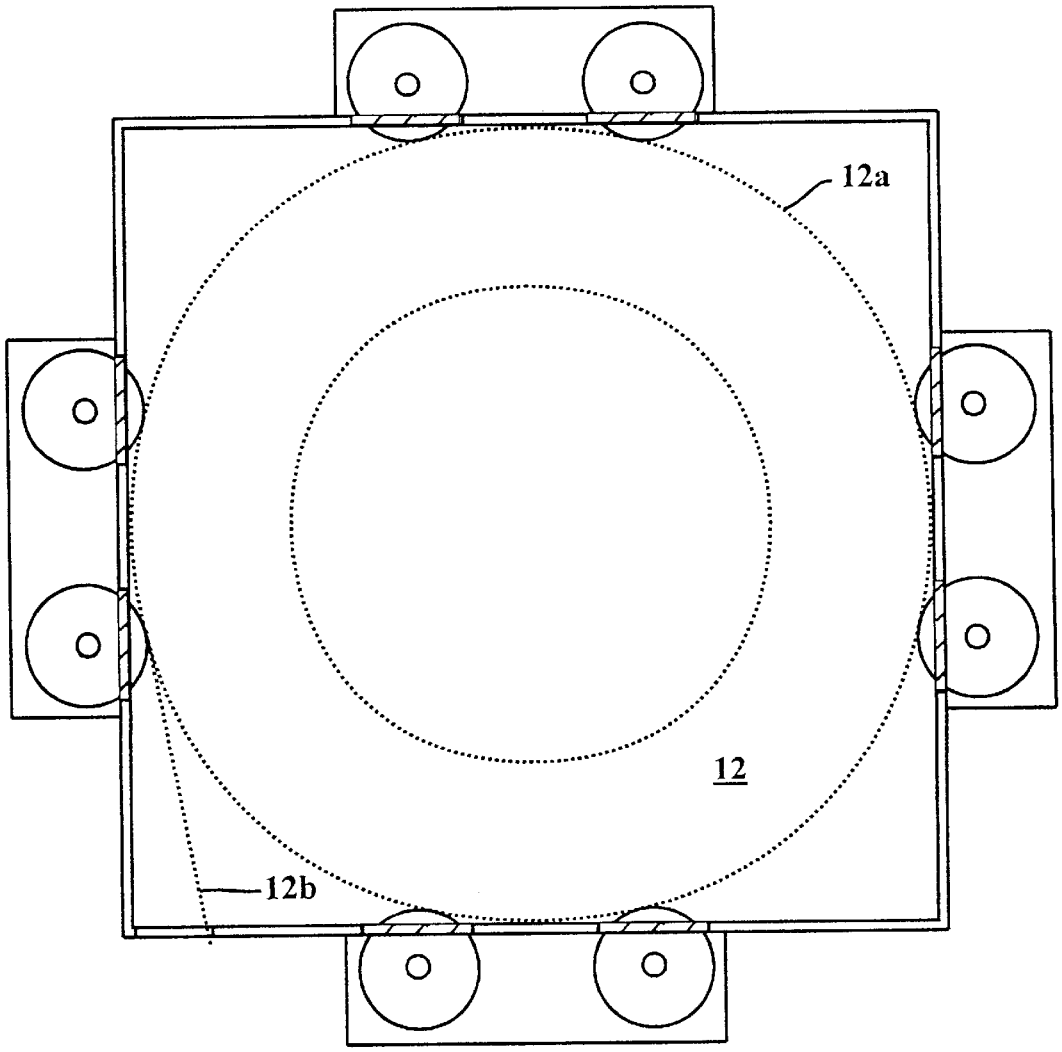

Referring to FIGS. 5 and 7, the location of the apertures 14 preferably correspond with roller assemblies 20 of a dispensing apparatus. As explained in further detail below, when the package containing the coil is loaded onto the dispensing apparatus, rollers 22 are positioned to rotatably engage the coiled material through the open apertures 14 of the sidewalls 13 of the container 10 (i.e., the rollers make tangential contact with the coil such that the rollers will rotate in the direction in which the stock is withdrawn from, or retracted into, the container 10). Preferably, the rollers 22 rotatably engage the outer surface 12*b* of the coiled material by applying a force against the outer surface 12*b* of the coiled material that is sufficient to reduce or eliminate friction caused by the contact of the coil 12 and the inner surface of the sidewalls 13, thereby enabling free movement of the coiled material out of and back into the container through aperture 15.

FIG. 2 is a plan view of a flat unitary blank from which the packaging device of FIG. 1 may be formed. The flat unitary carton blank shown in FIG. 2 can be folded to form the rectangular packaging device and dispenser shown in FIG. 1. The blank may comprise any suitable material such as corrugated cardboard. The blank comprises a center section 40 having fold lines 41 that define the edges of the first panel 1*a* (FIG. 1) in the shape of a rectangle. A plurality of folding sections 42 each comprising a sidewall section 43 and a portion (45*a*, 45*b*, 45*c*, 45*d*) of a second panel (bottom panel) are foldable relative to the center section 40 to form the container 10 shown in FIG. 1. More specifically, each sidewall section 43, which is defined by folding lines 41 and 44, comprise rectangular flap sections that integrally extend from, and are folded at right angles to, the edges (fold lines 41) of the center panel 40. Each sidewall section 43 of the unitary blank comprises one or more perforated regions 13 that define apertures in the sidewalls. Again, rollers are inserted through the apertures to rotatably engage a coil contained therein during a dispensing process.

The plurality of second panel sections 45*a*, 45*b*, 45*c*, and 45*d*, comprise rectangular flap sections that integrally extend from, and are folded at right angles to, the edges (fold lines 44) of the sidewall sections 43. The second panel sections 45*a*, 45*b*, 45*c*, and 45*d*, which are folded to form the bottom panel 11*b* of the container 10, provide a two-ply construction. For instance, flap sections 45*a* and 45*c* comprise an inner ply of the bottom panel 11 and are folded and secured using any suitable manner such as by securing the terminating edges of sections 45*a* and 45*c* by an adhesive sealing tape, etc. Flap sections 45*b* and 45*d* comprise an outer ply of the bottom panel 11*b* and are folded over the secured sections 45*a* and 45*c* and then secured using any suitable manner such as by gluing the second ply formed by sections 45*b* and 45*d* to the first ply formed by sections 45*a* and 45*c*, and/or by securing the terminating edges of sections 45*b* and 45*d* by an adhesive sealing tape, etc.

The unitary blank further comprises a plurality of tabs 46 that used to secure the corners of sidewalls. Each tab 46 foldably extends from a sidewall section 43 and is folded and secured (glued, etc.) to an inner surface of an adjacent sidewall 43. The corner of the container in which the exit aperture 15 is formed does not require a tab 46 to secure the adjacent sidewall sections 43. In addition, a view window 47 is preferably formed in center section 40 so that the amount of metal coil contained in the resulting container 10 can be readily determined.

As explained above, each of the rectangular sidewall sections 43 comprise one or more perforated regions 13 that define apertures. These apertures are strategically placed along these surfaces, corresponding with the rollers in the dispensing unit.

Figure 4:
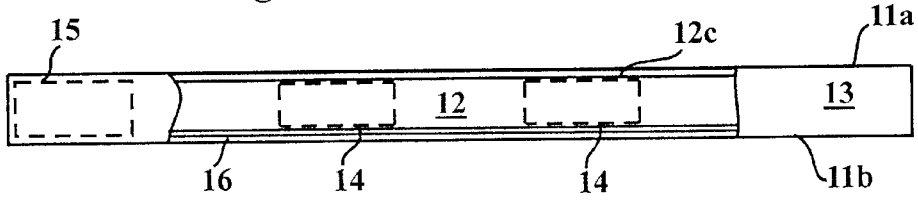
FIG. 4 is an enlarged perspective view of a sidewall of the packaging device of FIG. 1 illustrating components i within the packaging device.

In another embodiment, as shown in FIGS. 2 and 4, the packaging device comprises an insert 16 comprising a low friction surface that is preferably disposed on the inner surface of the bottom panel 11*b* so as to reduce friction as the coil 12 rotates in the packaging device. The low friction insert 16 may comprise a nylon or Teflon sheet, for example, which is glued to the inner surface of the bottom panel 11*b* to reduce the friction as the metallic coil is dispensed. The low-friction insert preferably provides a lower coefficient of friction than the material that is used to form the container 10. In addition, the insert 16 preferably matches the geometry of the bottom panel 11*b*. Further, a low friction insert may be disposed between the coil 12 and the inner surface of the upper panel 11*a* to prevent wear on the top surface of the coil and to protect the top surface of the enclosure. This is preferred when the metallic coil comprises a sharpened/serrated edge 12*c*.

In a further embodiment, packaging device may comprise point-of-contact reinforcements around or in proximity to the perforated regions 14 (or along the entire length of the sidewall) so as to provide additional strength of the sidewall to, e.g., withstand the spring force of the coil when the corresponding apertures are generated. The reinforcements may comprise any suitable rigid material such as metal or plastic and are affixed to the inside walls of the packaging. For instance, as shown in FIG. 2, a reinforcement device 48 is placed on the unitary blank (via glue, etc.) at the anticipated point of contact between the metallic coil and the sidewall sections 43 of the blank.

In addition, a clip or fastener may be utilized to secure the end 12*b* of the metallic material 12 when the packaging device is not positioned in the dispensing unit so as to prevent in coiling of the material into the packaging device during handling and storage.

Moreover, as noted above, the packaging device may comprise any suitable shape. For instance, the packaging device may comprise a polygonal such as an octagon or hexagon, with points of contact along the inside of the packaging and apertures located between the points of contacts to allow engaging of the rollers. Further, the packaging device may be circular in construction with inserts creating points of contact on the inside of the container and apertures located between the points of contact to allow engaging of the rollers.

Figure 6:
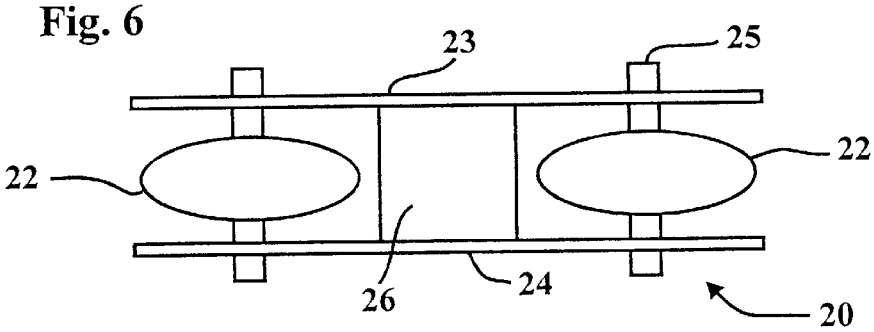

FIGS. 5, 6 and 7 comprise schematic diagrams collectively illustrating a method and apparatus for dispensing coiled metallic ribbon stock according to an embodiment of the present invention. Referring to FIG. 5, a schematic diagram illustrates an apparatus for dispensing the coiled material 12 from the packaging device wherein the apparatus comprises a plurality of roller assemblies 20. In a preferred embodiment, at least one roller assembly 20 is disposed at a location on each sidewall 13 of the packaging device 13 having a point of contact with the coil 12. If the container 10 is manufactured with the perforations or apertures 14, the roller assemblies 20 are disposed such that the rollers 22 are aligned with the apertures 14.

FIG. 6 is a schematic of a roller assembly 20 according to an embodiment of the present invention. The roller assembly 20 is a component of the dispensing apparatus that is positioned (automatically or manually) to rotatably engage and disengage the coiled metal ribbon stock 12 through the apertures 14 in the container 10. A roller assembly 20 comprises a bracket 21 on which one or more rollers 22 are mounted. The bracket 21 comprises. a first plate 23 and a second plate 24 and the rollers 22 are rotatably mounted therebetween using mounting bracket 25 (e.g., bolt). The roller assembly further comprises a mounting plate 26 (connected between the first and second plates 23, 24) that is used for connecting the roller assembly 20 to a device or system (e.g., hydraulic, pneumatic, power screw, etc.) for moving the roller assembly 20 to engage or disengage the coil 12. For instance, the mounting bracket 26 can be used to connect the roller assembly to one end of a piston rod that is used to move the roller assembly.

FIG. 5 illustrates the dispensing apparatus in a state of operation prior to engaging the coiled metallic ribbon stock 12 in the container 10. The roller assemblies 20 are first positioned at locations along the sidewall comprising the apertures 14. FIG. 7 illustrates the dispensing apparatus in a state of operation after engaging the packaging device. As shown, when the container 10 containing the coil 12 is loaded onto the dispensing apparatus, the roller assemblies 20 are controllably moved toward the sidewalls 13 until the rollers 22 make tangential contact to the coiled material through the open apertures 14 of the sidewalls 13 of the container 10. Preferably, each roller assembly 20 is positioned such that sufficient force is applied by the rollers 20 against the coil 12 to mitigate or eliminate the frictional forces caused by the contact between the outer surface 12*a* of the coil 12 and the inner surface of the sidewalls 13 as the metallic rule is withdrawn. The rollers 20 advantageously enable free movement of the coiled material 12 out of and back into the packaging device through aperture 15.

It is to be understood that the roller assembly 20 may be constructed in any suitable fashion and may comprise any number of rollers 22. Preferably, the roller assembly 20 is constructed such that when the roller assembly 20 is engaged, the only points of contact are between the rollers 22 and the coil 12. In other words, the roller assembly 20 is preferably designed such that during the dispensing operation, no portion of the roller assembly is in contact with the sidewall 13, potentially resulting in exertion of inward force against the sidewall 13.

Figure 8:
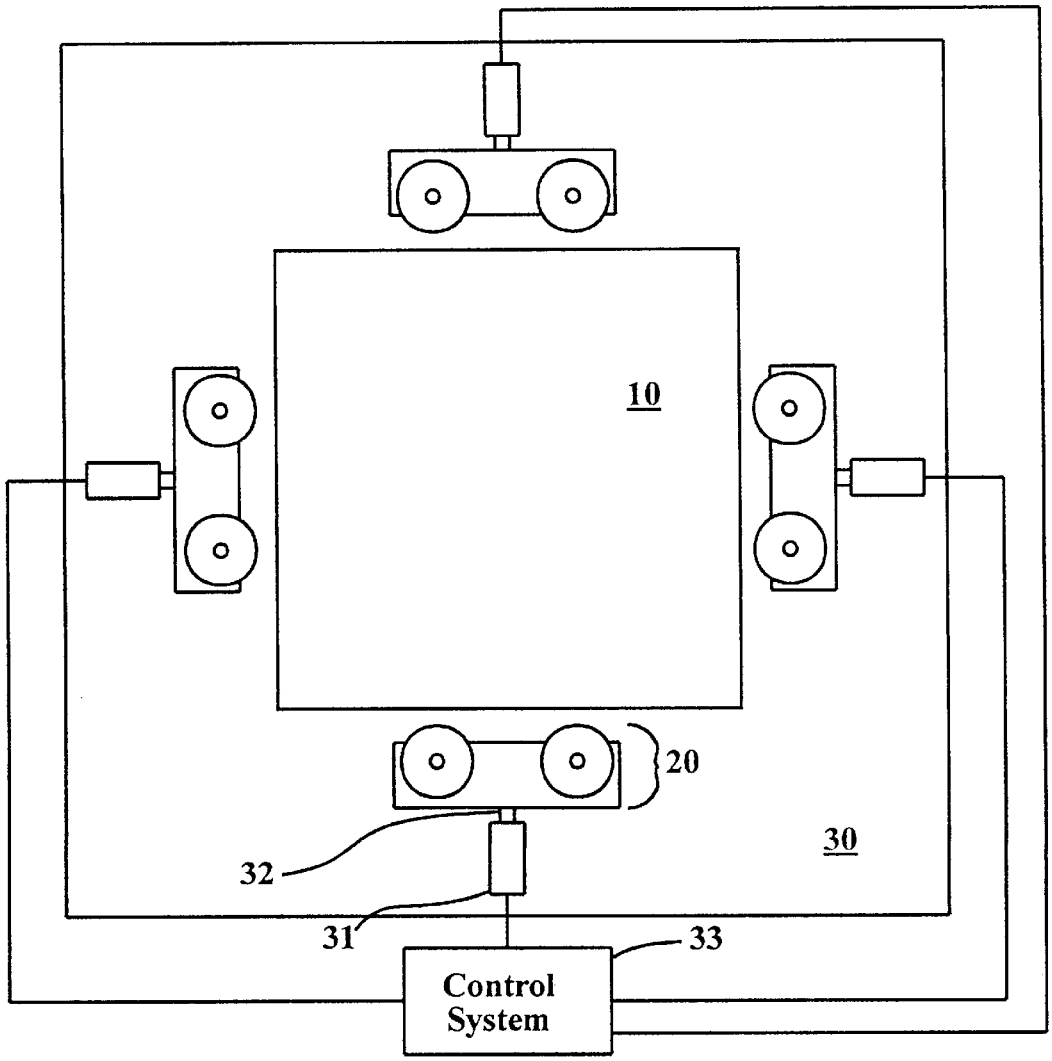
FIG. 8 is a schematic illustrating a dispensing apparatus according to another embodiment of the present invention.

FIG. 8 is a schematic illustrating a dispensing apparatus according to an embodiment of the present invention. The dispensing apparatus comprises a mounting table 30 for holding the packaging device in place during a dispensing operation. The packaging device can be mounted and positioned on the table 30 using any suitable device (e.g., adjustable brackets, etc.) Those skilled in the art can readily envision other suitable mechanisms or apparatus that may be implemented for stably mounting the packaging device prior to a dispensing operation.

As noted above, the dispensing unit comprises a plurality of roller assemblies 20 that are moved to engage/disengage the coil 12. In one embodiment, the roller assemblies are each connected to a piston 32 and cylinder 31 assembly, wherein the cylinder is mounted to the table 30. A control system 33 is operatively connected to each piston 32 and cylinder assembly to cause the pistons 32 to extend from the cylinders 31 and until contact is made between the rollers 22 and the coil with sufficient force. It is to be appreciated that the control system 33 may comprise any suitable automated system known to those skilled in the art such as a hydraulic, pneumatic, or servo system, which is operated via an application running on a computer-based system. With such systems, feedback controls could be implemented to ensure that the roller assembly applies proper force when it is engaged with the coil. These types of automated systems and feedback controls are well known in the art and can readily be implemented with the current invention. Therefore, such automated systems will not be discussed in further detail.

In another embodiment, movement of the roller assemblies may be performed manually using any suitable mechanical device such as a power screw system (analogous to a vise grip system), whereby the user can manually turn a crank handle that rotates a cylindrical rod (connected to the roller assembly) comprising helical or advancing spiral threads that cause a roller assembly to move along guide rail to and from the packaging device. Again, those of ordinary skill in the art may readily envision various manual mechanisms that may be implemented for positioning the roller assemblies.

It is to be appreciated that the dispensing apparatus shown in FIG. 8 may be oriented horizontally or vertically or at any other angle, to facilitate feeding of the material into different cutting or processing equipment.

One of ordinary skill in the art can readily envision other structures for implementing a dispensing apparatus based on the teachings herein. For instance, the dispensing apparatus can comprise a combination of movable and stationary roller assemblies, whereby the packaging device is positioned so that the metallic coil engages the stationary rollers and then the movable rollers are subsequently positioned to engage the coil.

In another embodiment, the dispensing apparatus may comprise an active roller system, whereby one or more of the roller assemblies are. driven by a motor so as to move the coiled metallic ribbon stock into and out of the container. In this instance, the rollers may have a surface treatment to increase the friction between the roller and the metallic ribbon stock as the rollers drive the stock.

Furthermore, although preferred embodiments described above utilize a roller mechanism to engage the stock, other suitable friction reduction means that can be inserted through an aperture in the container for reducing the friction at points of contact between the coil of metallic ribbon stock and the inner surface of the container may be employed herein. For instance, a small plate comprising a compound having a suitably low coefficient of friction can be forcibly applied against the metallic ribbon stock through an aperture in the container to reduce the friction at points of contact of the metallic ribbon stock and the container.

Although illustrative embodiments have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A device for packaging a coil of metallic ribbon stock, comprising:

a first planar panel and a second planar panel, wherein the first and second planar panels have substantially the same shape; and a sidewall panel that interconnects the first and second planar panels along the perimeter of the first and second planar panels to form a container;

wherein the sidewall panel comprises a perforated region that defines an aperture, the aperture being adapted to insertably receive a roller that contacts a coil of metallic ribbon stock within the container with a force that reduces friction caused by contact of the coil and an inner surface of the sidewall panel.

2. The device of claim 1, wherein the perforated region is formed in proximity to a point of contact between the inner surface of the sidewall panel and an outer surface of a coil of metallic ribbon stock within the container.

3. The device of claim 1, wherein the perforated region is removed to form the aperture in the sidewall.

4. The device of claim 1, further comprising a low friction insert connected to the inner surface of one of the first planar panel, the second planar panel, and both.

5. The device of claim 1, further comprising a reinforcement device connected on the inner surface of the sidewall panel in proximity to the perforated region for reinforcing the sidewall panel.

6. A unitary flat blank foldable to form the device of claim 1.

7. A device for packaging a coil of metallic ribbon stock, comprising:

a first planar panel and a second planar panel, wherein the first and second planar panels have substantially the same shape; and a sidewall panel that interconnects the first and second planar panels along the perimeter of the first and second planar panels to form a container;

wherein the sidewall panel comprises an aperture, the aperture being adapted to insertably receive a roller that contacts a coil of metallic ribbon stock within the container with a force that reduces friction caused by contact of the coil and an inner surface of the sidewall panel.

8. The device of claim 7, wherein the aperture is formed in proximity to a point of contact between the inner surface of the sidewall panel and an outer surface of a coil of metallic ribbon stock within the container.

9. The device of claim 7, further comprising a low friction insert connected to the inner surface of one of the first planar panel, the second planar panel, and both.

10. The device of claim 7, further comprising a reinforcement device connected on the inner surface of the sidewall panel in proximity to the aperture for reinforcing the sidewall panel.

11. A unitary flat blank foldable to form the device of claim 7.

12. A flat blank foldable into a container for packaging and dispensing a coil of metallic ribbon stock, the blank comprising:

a center section having fold lines that define the edges of a first panel of the container; and a plurality of folding sections each extending from an edge of the first panel;

wherein at least one folding section comprises a sidewall section and second panel section separated by a fold line;

wherein the sidewall section comprises a perforated region that defines an aperture, the aperture being adapted to insertably receive a roller that contacts a coil of metallic ribbon stock within the container with a force that reduces friction caused by the contact of the coil and an inner surface of the sidewall panel; and wherein the plurality of folding sections are foldable relative to the first panel section to form the container.

13. The blank of claim 12, further comprising a folding tab connected to a sidewall section, wherein the folding tab connects the sidewall section to an adjacent sidewall section.

14. The blank of claim 12, wherein the first panel comprises a perforated region defining an aperture that is disposed on the first panel to view the content of the container.

15. The blank of claim 12, further comprising a reinforcement device connected on the inner surface of the sidewall section in proximity to the perforated region for reinforcing the sidewall panel.

16. The blank of claim 12, wherein the center section and the folding sections are rectangular.

17. A flat blank foldable into a container for packaging and dispensing a coil of metallic ribbon stock, the blank comprising:

a center section having fold lines that define the edges of a first panel of the container; and a plurality of folding sections each extending from an edge of the first panel;

wherein at least one folding section comprises a sidewall section and second panel section separated by a fold line;

wherein the sidewall section comprises an aperture, the aperture being adapted to insertably receive a roller that contacts a coil of metallic ribbon stock within the container with a force that reduces friction caused by the contact of the coil and an inner surface of the sidewall panel; and wherein the plurality of folding sections are foldable relative to the first panel section to form the container.

18. A device for packaging a coil of metallic ribbon stock, comprising:

a first planar panel and a second planar panel, wherein the first and second planar panels have substantially the same shape; and a sidewall panel that interconnects the first and second planar panels along the perimeter of the first and second planar panels to form a container, wherein an inner surface of the sidewall contacts a coil of metallic ribbon stock, which is wound under tension, at one or more contact points between an outermost portion of the coil and the inner surface of the sidewall;

wherein the sidewall panel comprises an aperture or a perforated region that defines an aperture, wherein the aperture or the perforated region is formed in proximity to a point of contact between the inner surface of the sidewall panel and an outer surface of the coil placed in the container.

* * * * *